US008931451B2

(12) United States Patent
Scheidig

(10) Patent No.: US 8,931,451 B2
(45) Date of Patent: Jan. 13, 2015

(54) CAMSHAFT ADJUSTER

(75) Inventor: Gerhard Scheidig, Oberasbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/126,199

(22) PCT Filed: Feb. 24, 2012

(86) PCT No.: PCT/EP2012/053160

§ 371 (c)(1),
(2), (4) Date: Dec. 13, 2013

(87) PCT Pub. No.: WO2012/171670

PCT Pub. Date: Dec. 20, 2012

(65) Prior Publication Data

US 2014/0116365 A1 May 1, 2014

(30) Foreign Application Priority Data

Jun. 16, 2011 (DE) ..... 10 2011 077 586

(51) Int. Cl.
*F01L 1/34* (2006.01)
*F01L 1/344* (2006.01)

(52) U.S. Cl.
CPC ..... *F01L 1/344* (2013.01); *F01L 1/34409* (2013.01); *F01L 1/3442* (2013.01)
USPC ..... 123/90.17; 123/90.15

(58) Field of Classification Search
CPC ..... F01L 1/344
USPC ..... 123/90.15, 90.17, 90.31
See application file for complete search history.

(56) References Cited

U.S. PATENT DOCUMENTS

| | | | | |
|---|---|---|---|---|
| 5,263,443 | A | 11/1993 | Schlechter et al. | |
| 6,666,181 | B2 | 12/2003 | Smith et al. | |
| 7,318,401 | B2 * | 1/2008 | Pluta et al. | 123/90.17 |
| 2012/0210961 | A1 | 8/2012 | Scheidig | |

FOREIGN PATENT DOCUMENTS

DE 10 2009 056 020 6/2011

* cited by examiner

*Primary Examiner* — Zelalem Eshete
(74) *Attorney, Agent, or Firm* — Davidson, Davidson & Kappel, LLC

(57) ABSTRACT

A camshaft adjuster (1) having a control device (4), wherein by means of the control device (4) a selection can be made between an OPA and-or a CTA mode, and the camshaft adjuster (1) has a third hydraulic medium duct CC which positions the camshaft adjuster (1) in a central position.

10 Claims, 5 Drawing Sheets

CAMSHAFT ADJUSTER

The present invention relates to a camshaft adjuster.

BACKGROUND

Camshaft adjusters are used in internal combustion engines to vary the control times of the combustion chamber valves. Adjusting the control times to the instantaneous load and rotational speed reduces consumption and emissions. The vane-type adjuster is a common design. Vane-type adjusters have a stator, a rotor and a drive wheel. The rotor is usually rotatably fixedly connected to the camshaft. The stator and the drive wheel are also connected to each other, the rotor being located coaxially to the stator and within the stator. The rotor and stator form oil chambers (vanes), to which oil pressure may be applied and which permit a relative movement between the stator and rotor. The vane-type adjusters furthermore have various sealing covers. The assembly having the stator, drive wheel and sealing cover is formed by multiple screw connections.

A camshaft adjuster is known from U.S. Pat. No. 6,666,181 B2. Rotor 30, which is the output element, has a bypass in addition to the known hydraulic medium ducts. The bypass transports the displaced hydraulic medium from one working chamber to the oppositely acting working chamber. Once the bypass is covered by the stator, the driving element, this hydraulic medium flow stops. The rotor is now located in a central position. The bypass is controlled by a control piston which is able to permit or block the hydraulic flow from a bypass to a hydraulic medium duct. In known methods, the conventional hydraulic medium ducts are provided with check valves to use the camshaft alternating torques for adjustment by redirecting the hydraulic medium volume to be displaced from one working chamber to the oppositely acting working chamber at the point in time of a camshaft alternating torque. In the corresponding axial position of the control piston, the hydraulic medium ducts which repump the hydraulic medium flow in the desired adjusting direction of the rotor are switched to the hydraulic medium flow.

SUMMARY OF THE INVENTION

It is an object of the present invention to provide a camshaft adjuster which facilitates the reaching of an intermediate position.

The present invention provides that the adjusting means may be placed in an intermediate position between its extreme positions with the aid of a control device, in particular a central valve, which facilitates either the use of camshaft alternating torques (CTA mode) and/or the use of the hydraulic medium pressure (OPA mode). In the extreme positions of the adjusting means, the adjusting means is in contact with the abutment. The one working chamber has a maximum volume, while the oppositely acting working chamber has a minimum volume or a zero volume. The intermediate position is ideally the central position. The special features are the design and mode of operation of the central valve, which includes a valve housing, a valve sleeve and a control piston. The valve housing rotates synchronously with the camshaft and has an opening arrangement of bore holes, windows, elongated holes, grooves and the like on its circumference. Situated coaxially thereto is the valve sleeve, which also includes multiple bore holes, windows, elongated holes, grooves and the like on its circumference. The valve sleeve is prevented from rotating around the camshaft axis by a form fit or the like. Certain through-openings, which are determined by positive control and in a predefined manner from the relative rotation of the valve housing and valve sleeve, are switched into the hydraulic medium flow as a function of the camshaft angle, the through-flow being permitted or blocked by the two components primarily in the radial direction. Due to its axial position relative to the valve sleeve, the control piston situated coaxially to the valve sleeve permits or blocks the hydraulic medium flow of the opening arrangement in the valve sleeve on the inner diameter of the valve sleeve with the aid of control edges or openings provided on the control piston. The control piston is actively controllable in its axial position by a central magnet. In the de-energized or non-activated state, the control piston may be moved into its idle position via a restoring spring, usually a pressure spring.

According to the present invention, the control device of the camshaft adjuster has a blocking function which takes effect when no more hydraulic medium supply pressure is present. In the absence of hydraulic medium supply pressure in the control device, in particular the central valve, a component is placed in a position which largely blocks the hydraulic medium ducts, so that no more hydraulic medium flows out of the working chambers back to the control device and to the hydraulic medium supply or tank. This blocking position of a component of the control device is preferably achieved by a spring means, in particular a closing spring, so that, when it is not actuated by a central magnet, this component is moved by the blocking function of the control device to an idle position which largely corresponds to the blocking position. The adjusting means may thus be placed in an intermediate position with the aid of this camshaft adjuster, which may be used to actively choose between an OPA mode and a CTA mode, since the adjusting means remains hydraulically clamped.

In one embodiment of the present invention, the valve sleeve is axially shiftably supported within the valve housing. The form fit, which prevents a synchronous rotation of the valve sleeve together with the valve housing, is provided in the axial direction in such a way that sufficient coverage remains in the form fit to block a rotary motion of the valve sleeve. A spring means, which is the closing spring, acts against an active hydraulic medium supply pressure. The closing spring is advantageously designed as a pressure spring which is situated on the side facing away from the camshaft and partially surrounds the valve sleeve or is partially guided on the outer diameter of the valve sleeve. The closing spring is fixedly supported on the housing, for example on the central magnet, which actuates the control piston in the axial direction. An abutment for the valve sleeve is provided on the opposite side of the position of the closing spring. A hydraulic medium supply pressure, which moves the valve sleeve against the closing spring, is applied from the side facing the camshaft. The openings to the hydraulic medium ducts are thus released for a hydraulic medium flow.

A pressure spring, referred to in the following as the piston spring, which positions the control piston against an abutment on the valve sleeve, is supported on the valve sleeve. The relative position and the working range of the control piston in relation to the valve sleeve are thus ensured. When the hydraulic medium supply pressure is applied to the valve sleeve, the valve sleeve strikes the housing-fixed support of the closing spring after a completed axial shifting.

If the control piston is in the position necessary for the intermediate position, the hydraulic medium flow through the predefined opening arrangement of the valve sleeve with the openings in the valve housing is switched in such a way that an alternating filling of the working chambers takes place, for example at camshaft angles of 180 degrees and 0 degrees.

While pressure is being applied to the one working chamber, the hydraulic medium of the other working chamber is confined or diverted to the tank. This alternating opening and closing is implemented by the aforementioned positive control between the valve sleeve and the valve housing. The third hydraulic medium duct is either connected to the tank, i.e., to the outflow, or pressure is also applied to it as a function of the camshaft angle or it is emptied.

If the adjusting means is in an extreme/abutment position, at least one mouth of the third hydraulic medium duct is opened to the working chamber having the larger volume. If an adjustment is now to take place in the intermediate position or central position, the control piston is moved to the axial position provided for this purpose. The third hydraulic medium duct is in hydraulic medium connection with the outflow or tank at least during a certain camshaft angle range, preferably during one complete camshaft rotation. Pressure is now applied to one of the two known hydraulic medium ducts, while the other duct is closed. This is done alternately as a function of the camshaft angle, preferably synchronously with the occurring camshaft alternating torque in the direction resulting from the implemented application of pressure. The working chamber having the larger volume, which is to be reduced for the purpose of achieving the intermediate or central position, has an open connection via the mouth of the third hydraulic medium duct to the tank. This allows the hydraulic medium to flow off, and the adjusting means moves in the direction of the intermediate or central position. The process is concluded when the intermediate or central position is reached, since in this position of the adjusting means both mouths of the third hydraulic medium duct are positively closed to both working chambers by being covered by a lateral component. If a camshaft alternating torque is active in a certain rotary direction, starting from the intermediate position of the adjusting means, the adjusting means undergoes minimal movement, the mouth of the third hydraulic medium duct is opened to the working chamber having the increasing volume, and the resulting rotary motion is thus hindered by an underpressure being produced in this working chamber and is simultaneously hydraulically supported by the largely incompressible hydraulic medium in the working chamber having the volume to be reduced. At the same time, the building pressure is decreased by the positively controlled application of pressure from the relative rotation of the valve housing and valve sleeve in relation to each other to one of the working chambers via the mouth of the third hydraulic medium duct which is opened to the outflow.

In an alternative, advantageous embodiment, the control piston is moved by the hydraulic medium supply pressure into a position ready for operation, in which the hydraulic medium ducts may be switched into the hydraulic medium flow. The absent hydraulic medium supply pressure allows the control piston to be moved by a closing spring into an axial position which blocks the hydraulic medium ducts in such a way that no hydraulic medium flow from or to the working chambers is possible. This ensures that the hydraulic medium remains in the working chambers and the adjusting means is hydraulically clamped.

In another alternative, advantageous embodiment, the valve housing is moved by the hydraulic medium supply pressure into a position ready for operation, in which the hydraulic medium ducts may be switched into the hydraulic medium flow. The absent hydraulic medium supply pressure allows the valve housing to be moved by a closing spring into an axial position which blocks the hydraulic medium ducts in such a way that no hydraulic medium flow from or to the working chambers is possible. This ensures that the hydraulic medium remains in the working chambers and the adjusting means is hydraulically clamped.

The hydraulic clamping of the adjusting means may be implemented in any position of the adjusting means. This refers to any intermediate position between the abutment/extreme positions of the adjusting means, ideally as centrally as possible between the abutment/extreme positions of the adjusting means and thus in the central position.

In one embodiment of the present invention, the following sequence of modes is assigned to the axial positions of the control piston as the energizing increases, starting in the de-energized position: intermediate or central position, OPA mode, CTA mode, regulated position, CTA mode, OPA mode.

The intermediate or central position of the adjusting means is largely defined by the location of the third hydraulic medium duct. The OPA mode is characterized by the application of pressure to one working chamber whose volume is to be increased and by emptying the working chamber whose volume is to be decreased. The emptying takes place through an opening to the tank or to the outflow. The CTA mode uses camshaft alternating torques, with the aid of which the pressure in one working chamber is increased, while this pressure is diverted to the other working chamber, which experiences an underpressure. The action of the oppositely acting camshaft alternating torque is suppressed by preventing the return flow. The adjusting means is thus gradually adjusted in one direction. The regulated state is based on the principle that the pressure is applied alternately to the working chambers, and the other working chamber in each case is closed at this instant and provides a supporting hydraulic cushion. In this way, each position of the adjusting means may be hydraulically maintained and clamped between the extreme positions. In the mode of the intermediate or central position, both effects are used, i.e., the hydraulic means pressure in combination with the camshaft alternating torques, both effects being synchronized in the directionally active instant. This is the advantage of moving to the intermediate or central position as quickly as possible when the engine starts and to switch from this position to the usual operating modes. The control piston is therefore preferably in a de-energized, axial position in this operating mode.

In an alternative embodiment of the present invention, the modes begin with the fully energized state of the central magnet or its action upon the control piston, i.e., in the following sequence: intermediate or central position, OPA mode, CTA mode, regulated position, CTA mode, OPA mode.

In one preferred embodiment, the adjusting means is mechanically locked in the intermediate or central position. This provides additional safety when approaching the various other operating modes from the intermediate or central position on engine startup. This mechanical lock is locked when the hydraulic medium pressure is low or absent and unlocked when the motor oil pressure increases. It is furthermore advantageous that, according to the present invention, the adjusting means is positioned in the intermediate or central position and mechanically locked when the engine is turned off.

In another embodiment of the present invention, the camshaft adjuster has a restoring spring which supports the adjusting means in an adjusting direction or acts against the drag torque or the friction torque of the camshaft. The restoring spring advantageously has a supporting effect on the reaching of the intermediate or central position.

Two restoring springs are advantageously provided. The one restoring spring acts in the "early position" direction and the other in the "late position" direction. The spring force thereof may be designed in such a way that this spring force of each restoring spring is minimal or zero when the adjusting means reaches the central position. Alternatively, one restoring spring acts under its maximum force upon reaching an abutment/extreme position of the adjusting means, while the force of the other restoring spring is minimal or zero.

In one embodiment of the present invention, the working chambers are sealed by a sealing means in such a way that the hydraulic medium remains in the working chambers, and a level of the hydraulic medium (oil sump) is maintained. A leakage is extremely minimal, preferably non-existent. Due to the confined hydraulic medium and the level maintained, the adjusting means has a hydraulic cushion of one working chamber in each direction of rotation, whereby a rotary motion of the adjusting means is prevented, at least damped. The amount of the level is based on the lowest lying gap between two components of the camshaft adjuster, which bridges the hydraulic medium flow through the hydraulic medium ducts. If the level is higher than the gap, the hydraulic medium flows, for example, to the tank or to a storage unit.

Due to the embodiment according to the present invention, a camshaft adjuster is available which is able to reach a central or intermediate position of the adjusting means by synchronizing the hydraulic medium pressure with camshaft alternating torques and to maintain this position by positive control (due to the relative rotation between the valve housing and the valve sleeve). In addition, an extremely fast adjustment is achieved by situating a third hydraulic medium duct, which empties at least once into each working chamber. The third hydraulic medium duct permits a geometrically predefined position of the adjusting means. The control device, which is able to close against a hydraulic medium supply pressure, confines hydraulic medium volumes in the working chambers and hydraulically locks the adjusting means in the desired position.

BRIEF DESCRIPTION OF THE DRAWINGS

Exemplary embodiments of the present invention are illustrated in the drawings.

DETAILED DESCRIPTION

Figure 1:
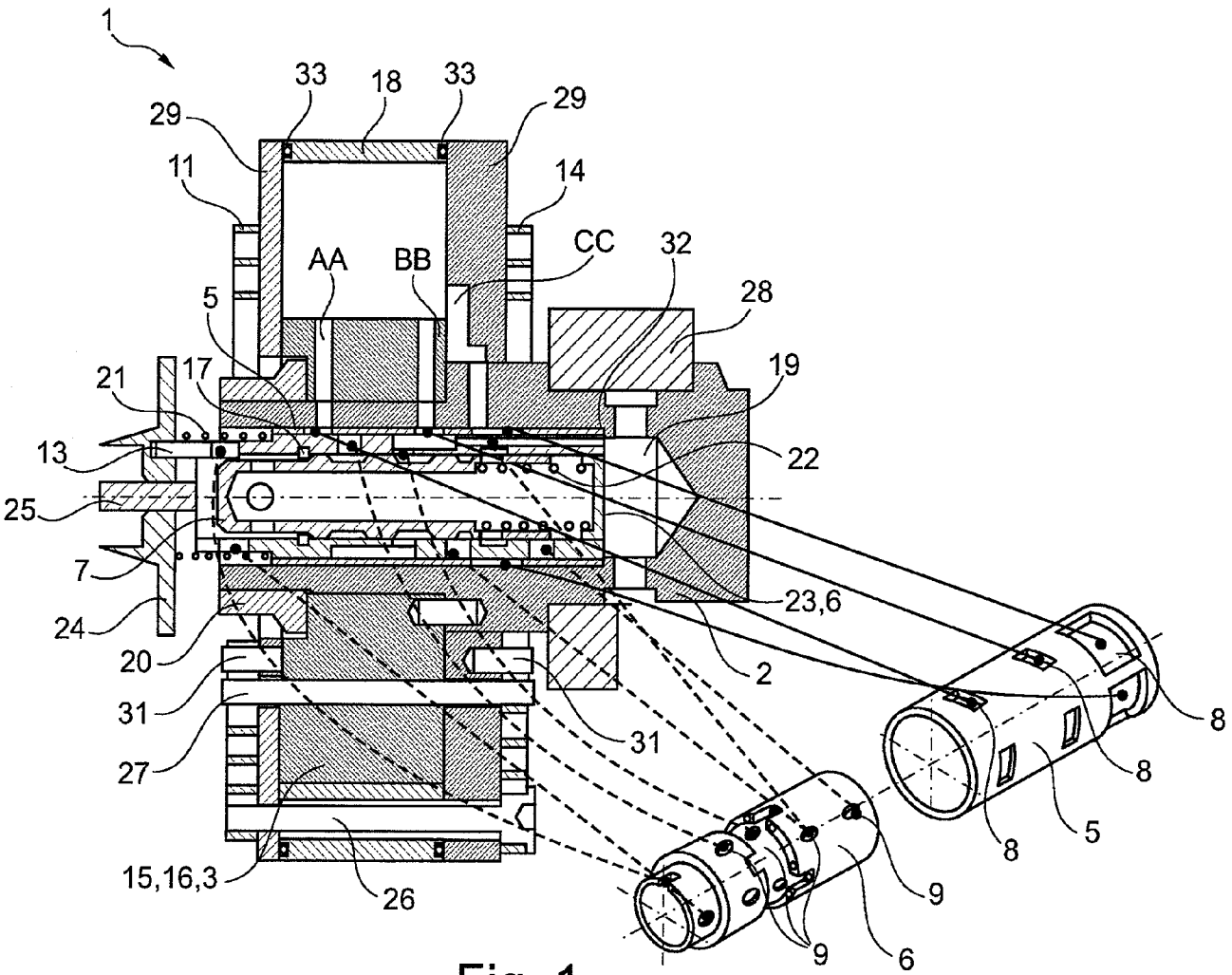
FIG. 1 shows a section of a camshaft adjuster according to the present invention, including the 3D representations of the valve housing and valve sleeve.

FIG. 1 shows a section of a camshaft adjuster 1 according to the present invention, including 3D representations of valve housing 5 and valve sleeve 6. Valve housing 5 has multiple openings 8 distributed on the circumference, designed as windows, bore holes, grooves or other types of fluid-conducting recesses. Valve sleeve 6 also has an opening arrangement 9 including corresponding windows, bore holes, grooves or other types of fluid-conducting recesses. Valve sleeve 6 is located concentrically within valve housing 5 during operation, valve housing 5 being rotatably fixedly provided with camshaft 2, which is not illustrated, and rotating relative to valve sleeve 6, valve sleeve 6 being prevented from synchronous rotation in relation to valve housing 5 by a form fit 13. As a result, openings 8 having opening arrangement 9 are opened and closed in timed intervals and open or block various hydraulic medium paths to working chambers A and B or to control piston 7. Openings 8 of valve housing 5 in the 3D representation are connected by unbroken lines for the sectional representation. The individual recesses of opening arrangement 9 in the 3D representation are connected by dashed lines for the sectional representation.

No hydraulic medium supply pressure P is shown in the representation illustrated. Valve sleeve 6 is located at abutment 32 due to the applied pressure of closing spring 21. Abutment 32 is provided as a single piece by camshaft 2. This closing mechanism operates without any additional, random external influence other than hydraulic medium supply pressure P. Closing spring 21 is supported by its one end on valve sleeve 6 and by its other end on central magnet 24 fixedly situated on the housing. Central magnet 24 randomly moves actuating pin 25 in the axial direction. If a hydraulic medium supply pressure P is introduced into cavity 19 via pressurizing medium rotary transducer 28 via camshaft 2, hydraulic medium supply pressure P acts upon actuating surface 23 of valve sleeve 6. Consequently, valve sleeve 6 shifts axially relative to valve housing 5 against closing spring 21. A control piston 7 having a piston spring 22 is situated concentrically within valve sleeve 6. Piston spring 22 presses control piston 7 against an abutment 17 of valve sleeve 6. The free distance between actuating pin 25 and control piston 7 in the absence of hydraulic medium supply pressure P is then closed by the presence of hydraulic medium supply pressure P and the resulting axial shifting of valve sleeve 6 together with control piston 7. Form fit 13 is maintained during the shifting of valve sleeve 6, generated by hydraulic medium supply pressure P. A relative change in position between control piston 7 and valve sleeve 6 does not take place. Only upon the random activation of central magnet 24 is actuating pin 25 moved axially and control piston 7 is able to shift axially in relation to valve sleeve 6, against piston spring 22. Control device 4 is then in a state ready for operation. The functionality of control device 4 in the state ready for operation is explained in greater detail in FIG. 2.

Camshaft adjuster 1 also has two disks 29 which are situated axially on the front face of camshaft adjuster 1. Disks 29 limit working chambers A and B on the axial side. Driving element 18 has a known tooth structure, which is not illustrated in further detail and which may be operatively connected to a crankshaft. Circumferential sealing elements 33 are situated between driving element 18 and disks 29 for the purpose of sealing working chambers A and B against leakage in the gravitational direction. After hydraulic medium supply pressure P has been turned off, a remnant of hydraulic medium remains in working chambers A and B. Output element 16 is situated concentrically to driving element 18. Output element 16 is supported on camshaft 2 and clamped to camshaft 2 by a central nut 20 in the axial direction. Control device 4 is located within camshaft 2. Restoring springs 11 and 14 are situated laterally on the front faces of camshaft adjuster 1. Their spring ends are supported on a screw 26, which axially secures the assembly of camshaft adjuster 1, without it first being mounted on camshaft 2. Screw 26 permits a relative rotary motion between output element 16 and driving element 18 but is rotatably fixedly connected to driving element 18. Output element 16 has a spring pin 27 which extends all the way through output element 16 and disks 29 in the axial direction. The other spring ends of restoring springs 11 and 14 are supported on the sections of spring pin 27 protruding from disks 29, depending on the relative angular position of output element 16 to driving element 18. Spring pin 27 also permits a relative rotary motion between driving element 18 and output element 16 but is rotatably fixedly connected to output element 16. Additional spring pins 31 are rotatably fixedly connected to disks 29. The interaction of spring pins 21, 27 and screw 26 with restoring springs 11 and 14 depending on the relative angular position between driving element 18 and output element 16 is explained in greater detail in FIG. 5.

Output element 16 has a section of hydraulic medium ducts AA and BB which largely extend in the radial direction. Camshaft 2 has additional sections of hydraulic medium ducts AA and BB which are fluid-conductively opposite the sections of output element 16. Camshaft 2 has a section of hydraulic medium duct CC, hydraulic medium duct CC continuing through camshaft-side disk 29 until hydraulic medium duct CC ultimately empties into one of working chambers A or B.

Figure 2:
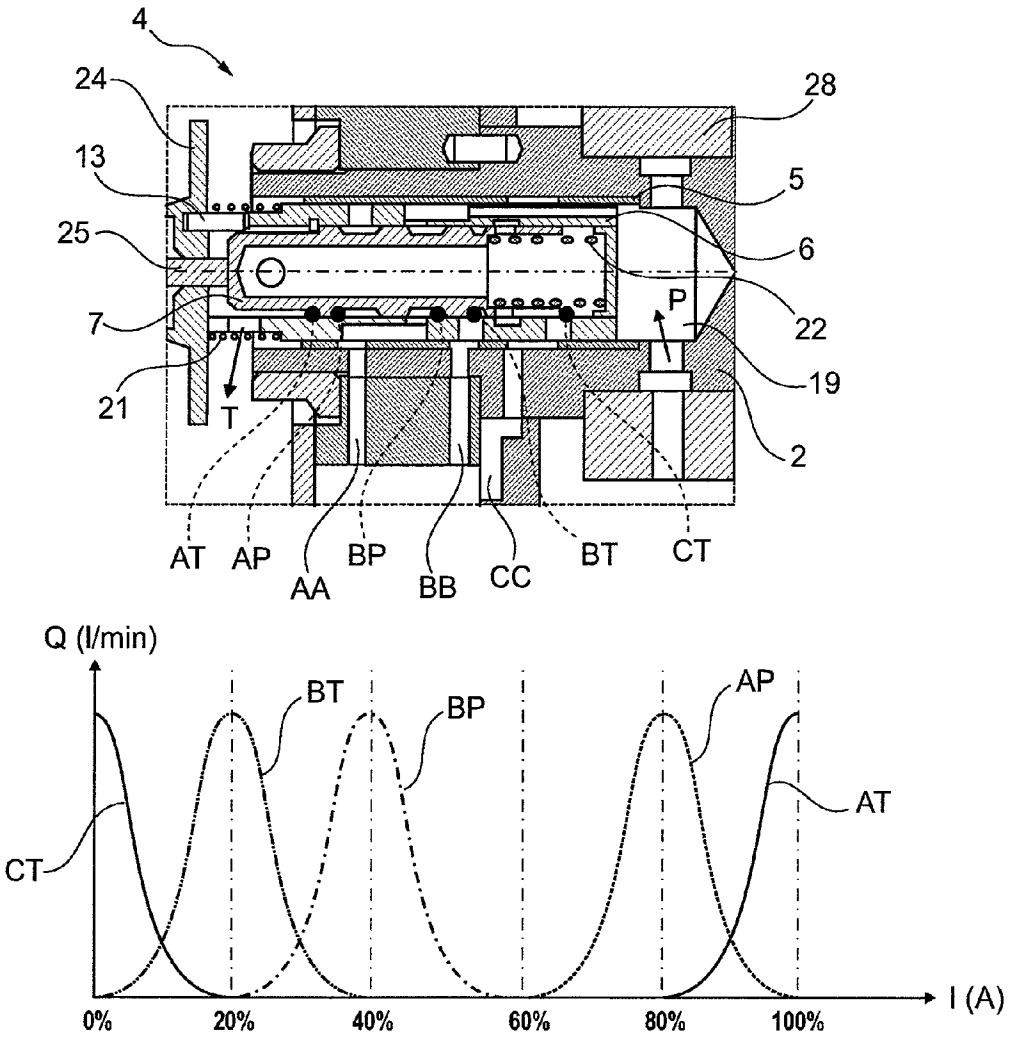
FIG. 2 shows a section of a first exemplary embodiment of the control device, including the corresponding Q-I characteristic curve.

FIG. 2 shows a section of a first exemplary embodiment of control device 4, including the corresponding Q-I characteristic curve. Control device 4 is located concentrically within a cavity 19 of a camshaft 2. Control device 4 includes a valve housing 5, a valve sleeve 6, a closing spring 21 and a control piston 7 having a piston spring 22. Control device 4 may also have a central magnet 24, which is not illustrated in further detail, including an actuating pin 25, on the side facing away from the camshaft. Actuating pin 25 shifts control piston 7 in the axial direction against the spring force of piston spring 22 when central magnet 24 is energized. Closing spring 21 presses valve sleeve 6 in the direction of the side of camshaft adjuster 1 facing the camshaft; however, a hydraulic medium supply pressure P is applied to valve sleeve 6 in this representation. Control device 4 is in the state ready for operation. The form fit for blocking the rotation of valve sleeve 6 is maintained during the axial movement of valve sleeve 6. In this state ready for operation of control device 4, actuating pin 25 is in contact with control piston 7. The Q-I characteristic curve shows the different volumetric flows of the hydraulic medium via the control edges identified by AT, AP, BP, BT and CT in the axial positions of the control piston. Hydraulic medium supply pressure P is supplied to control device 4 via pressurizing medium rotary transducer 28 and cavity 19 of camshaft 2 through the hydraulic medium paths provided for this purpose. The outflow to tank T is located on the side of control device 4 facing away from the camshaft, in particular between control device 4 and central magnet 24.

In the illustrated position of control piston 7, control edge CT is open all the way and permits a maximum hydraulic medium flow ("Q" on the ordinate) to tank T. At the same time, the energizing of the central magnet is 0 percent ("I" on the abscissa), and its actuating pin 25 is located in its starting position.

At 20-percent energizing, the camshaft adjuster is in OPA mode. An adjustment of adjusting means 3 in the desired direction is implemented by connecting control edge BT to tank T at maximum through-flow. Hydraulic medium supply pressure P is supplied to working chamber A or B whose volume is to be increased. In the illustrated example, working chamber A is the working chamber to which hydraulic medium supply pressure P is supplied via hydraulic medium duct AA.

At 40-percent energizing, i.e., when control edge BP is open all the way, camshaft adjuster 1 is in CTA mode. In the illustrated example, hydraulic medium supply pressure P is applied to working chamber A, taking into account the point in time or the angle range at which the camshaft alternating torque is active in the adjusting direction. This ensures a fast adjustment in CTA mode.

At 60-percent energizing, camshaft adjuster 1 is in regulated mode, and adjusting means 3 may hold any position between "early abutment" and "late abutment."

At 80-percent energizing, the AT control edge is closed and the AP control edge is open all the way. This mode corresponds to CTA mode, the camshaft alternating torques, together with pressure P, producing an adjustment, pressure being continuously applied to one working chamber A or B due to the arrangement of the components and openings of control device 4, while the other working chamber B or A only experiences a change in the states of the application of pressure and the volume confined in the working chamber. At the point in time of a camshaft alternating torque in the adjusting direction, pressure is applied to the corresponding working chamber, this working chamber only being closed, however, when the opposite camshaft alternating torque takes effect.

At 100-percent energizing, the AT control edge is open all the way and allows the hydraulic medium to flow out of, for example, working chamber A to tank T. In this angle range of the camshaft, in which the hydraulic medium is able to flow from working chamber A to tank T, the volume of working chamber A decreases, producing an adjustment.

Hydraulic medium duct CC is advantageously opened to the tank in the de-energized position of control piston 7. Depending on the position of adjusting means 3, the hydraulic medium in working chambers A or B is thus diverted, and working chambers A or B are emptied until hydraulic medium duct CC is closed by vane 15 of output element 16. Since this is done automatically, this mode is particularly suitable for starting the engine. After all, when the engine is turned off, adjusting means 3 may be in any position. When the engine is turned off, the adjusting means is automatically moved by the arrangement of hydraulic medium duct CC and control device 4 into an intermediate or central position in which the control times of the outlet and inlet valves are optimum for subsequently starting the engine.

Figure 3:
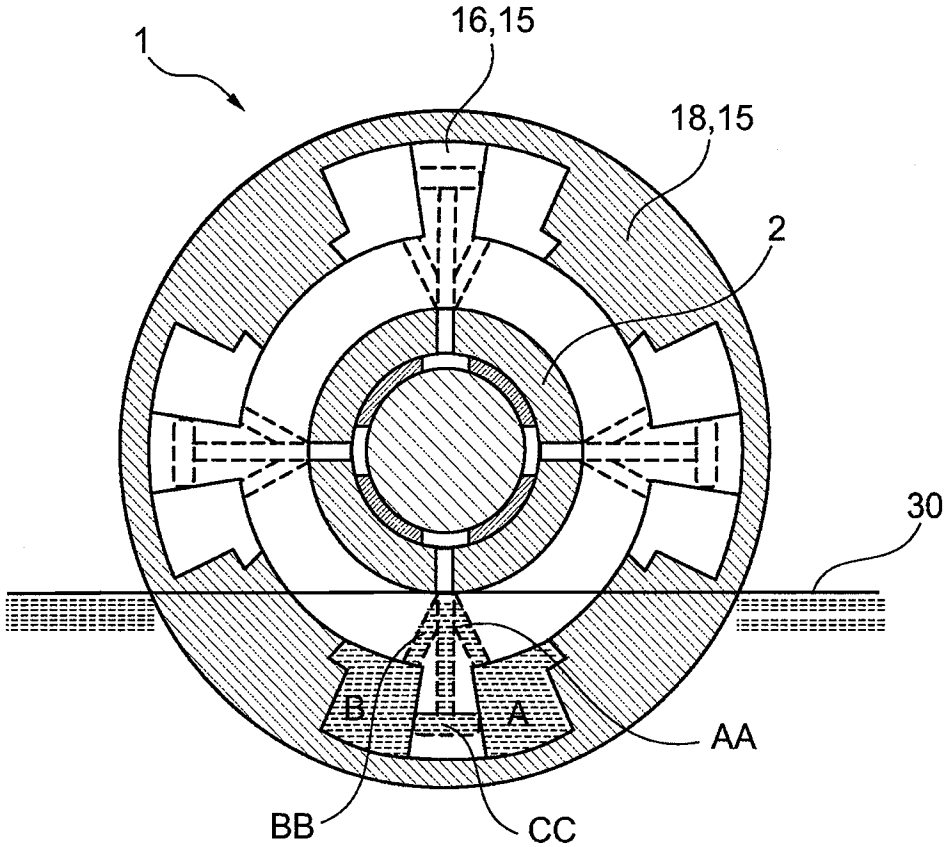
FIG. 3 shows a section of a camshaft adjuster according to the present invention in an angle position with the level of the hydraulic medium.

FIG. 3 shows a section of a camshaft adjuster 1 according to the present invention in a determined angle position with level 30 of the hydraulic medium in working chambers A and B. The determined angle position between output element 16 and driving element 18 is advantageously the central position in this example. In terms of its amount, illustrated level 30 is oriented toward a gap between camshaft 2 and output element 16. Above this amount, hydraulic medium can flow out through this gap when hydraulic medium supply pressure P is turned off (the engine is turned off) and control device 4 is closed. The rest of the hydraulic medium remains in working chambers A and B. If the engine is then started and hydraulic medium supply pressure P is building up, the camshaft alternating torques generate an alternating relative rotation between output element 16 and driving element 18. However, this alternating movement is damped by the confined hydraulic medium cushion in working chambers A and B. Due to the blocking function of control device 4, hydraulic medium in ducts AA, BB or CC does not flow out.

Figure 4:
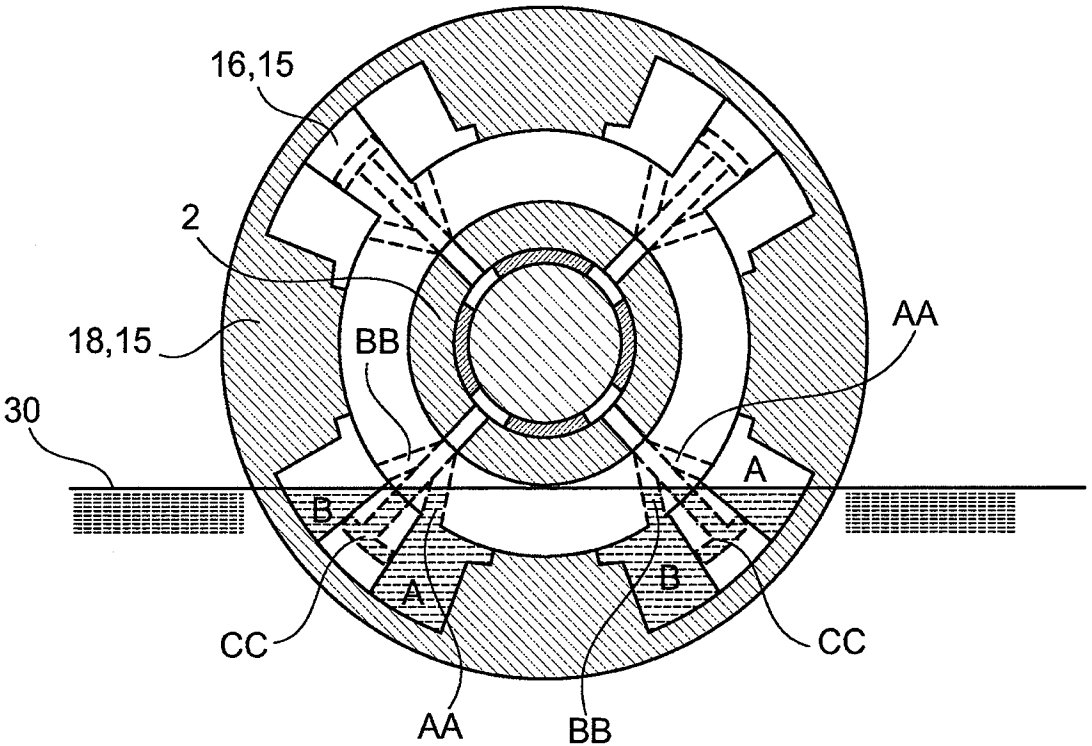
FIG. 4 shows a section of a camshaft adjuster according to the present invention in another angle position with the level of the hydraulic medium.

FIG. 4 shows a section of a camshaft adjuster 1 according to the present invention in another angle position with level 30 of the hydraulic medium. This angle position of camshaft adjuster 1 while the engine is turned off maintains hydraulic medium in working chambers A and B, similarly to the conditions of the arrangement shown in FIG. 3. Level 30 is preferably designed by the arrangement of sealing means 33 in such a way that both working chambers A and B are completely filled with hydraulic medium and remain full.

Figure 5:
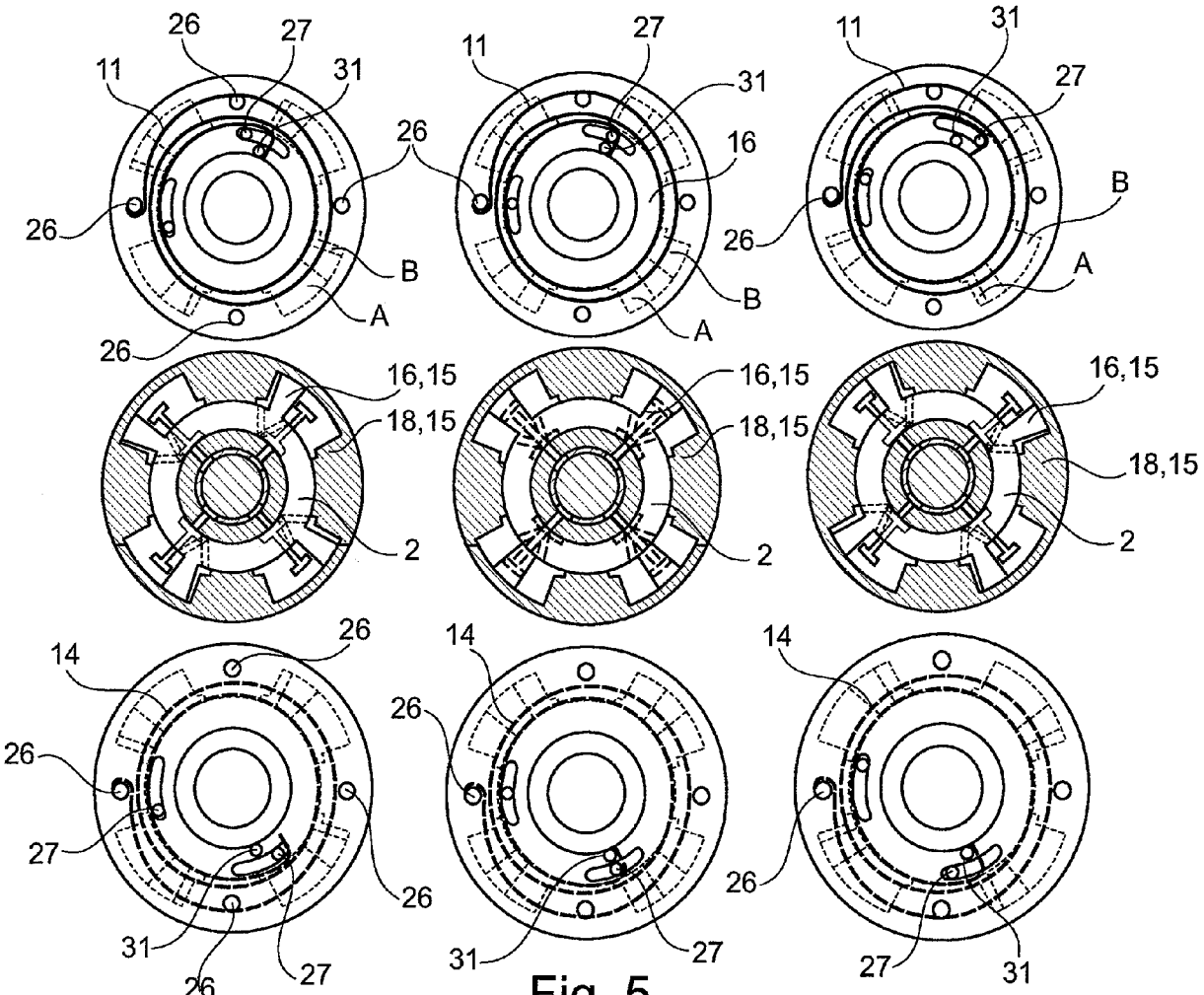
FIG. 5 shows an overview of the positions of the adjusting means of the camshaft adjuster with a view of the restoring springs.

FIG. 5 shows an overview of the positions of adjusting means 3 of camshaft adjuster 1 with a view of restoring springs 11 and 14.

Adjusting means 3 may assume three positions: "early abutment," "intermediate position," and "late abutment." "Early abutment" and "late abutment" are randomly named, exemplary abutment positions which depend on the definition of the adjusting direction of camshaft adjuster 1.

Adjusting means 3 in this case is designed as a vane 15 of output element 16, for example a rotor. Driving element 18, for example a stator, has vanes 15 which also extend in the radial direction and which, together with vanes 15 of driving element 18, define working chambers A and B. If the volume in working chamber A is minimal, adjusting means 3 is in an "early abutment" position. If the volume in working chamber B is minimal, adjusting means 3 is in a "late abutment" position.

If adjusting means 3 is in the "late abutment" position, restoring spring 11, which is located on the one front face of camshaft adjuster 1, is not tensioned by output element 16 and spring pin 27 attached thereto. Restoring spring 11 is supported by its one end on a spring pin 26 and by its other end on spring pin 31, spring pin 31 being fixedly connected to driving element 18. However, restoring spring 14, which is located on the opposite front face of camshaft adjuster 1, is tensioned by spring pin 27 of output element 16. The one end of restoring spring 14 is again supported on a spring pin 26, while the other end is supported on spring pin 27.

If adjusting means 3 is in the "intermediate position," the one end of restoring spring 14, which was still supported on spring pin 27 in the "late position" of adjusting means 3, is transferred from spring pin 27 to spring pin 31 by the rotary motion between output element 16 and driving element 18. The restoring torque of restoring spring 14 developed from the "late position" pushes output element 16, together with adjusting means 3, into the "intermediate position." However, the end of restoring spring 11, which was still supported on spring pin 31 in the "late position," now comes in contact with spring pin 27.

If adjusting means 3 is in the "early abutment" position, restoring spring 11 is pretensioned by spring pin 27. The spring end of restoring spring 11 was transferred from spring pin 31 to spring pin 27 in the "intermediate position," once the rotary motion of output element 16 to driving element 18 was continued in the direction of the "early abutment" position. However, the spring end of restoring spring 14 is now in contact with spring pin 31, and it is no longer being tensioned due to the rotary motion from the "intermediate position" to the "early abutment" position.

Due to the alternatingly acting arrangement of restoring springs 11 and 14, the adjusting means of output element 16 in an "intermediate position" is displaced even if no hydraulic medium supply pressure P is present.

LIST OF REFERENCE NUMERALS

1) Camshaft adjuster
2) Camshaft
3) Adjusting means
4) Control device
5) Valve housing
6) Valve sleeve
7) Control piston
8) Openings
9) Opening arrangement
10) Openings
11) Restoring spring
12) Sealing means
13) Form fit
14) Restoring spring
15) Vane
16) Output element
17) Abutment
18) Driving element
19) Cavity
20) Central nut
21) Closing spring
22) Piston spring
23) Actuating surface
24) Central magnet
25) Actuating pin
26) Screw
27) Spring pin
28) Pressurizing medium rotary transducer
29) Disk
30) Level
31) Spring pin
32) Abutment
33) Circumferential sealing elements
A) Working chamber A
B) Working chamber B
P) Hydraulic medium supply pressure
T) Tank
AA) Hydraulic medium duct AA
BB) Hydraulic medium duct BB
CC) Hydraulic medium duct CC

What is claimed is:

1. A camshaft adjuster for a camshaft, comprising:

a pressure chamber;

an adjuster situated in the pressure chamber, the adjuster dividing the pressure chamber into a first working chamber and a second working chamber, a first hydraulic medium duct enabling supply or discharge of hydraulic medium to or from the first working chamber through the first hydraulic medium duct, a second hydraulic medium duct enabling supply or discharge of hydraulic medium to or from the second working chamber through the second hydraulic medium duct so that the adjuster is movable by a pressure difference between the first working chamber and the second working chamber, resulting in a rotation of the camshaft;

a control device controlling the supply and discharge of hydraulic medium, the control device having a valve housing, a valve sleeve situated in the valve housing and rotatable relative to the valve housing, and a control piston axially shiftable within the valve sleeve, the valve housing having openings communicating with the first working chamber and the second working chamber, the valve housing rotating synchronously with the camshaft, and the openings in the valve housing being closed or released by a opening arrangement provided on the valve sleeve, the opening arrangement in the valve sleeve communicating with piston openings in the control piston, as a function of the axial position of the control piston, the control device blocking a hydraulic medium flow of all hydraulic medium ducts, including the first and second hydraulic medium ducts, of the first and second working chambers when no hydraulic medium supply pressure is present.

2. The camshaft adjuster as recited in claim 1 wherein the valve sleeve blocks the first and second hydraulic medium ducts for the hydraulic medium flow when no hydraulic medium supply pressure is present.

3. The camshaft adjuster as recited in claim 1 wherein the control piston is in an axial position in which the control piston is not actuated by an actuating device, and the first and second hydraulic medium ducts are blocked for the hydraulic medium flow when no hydraulic medium supply pressure is present.

4. The camshaft adjuster as recited in claim 1 wherein the valve sleeve permits a hydraulic medium flow to the first and second hydraulic medium ducts due to the action of the hydraulic medium supply pressure.

5. The camshaft adjuster as recited in claim 1 wherein the valve housing permits a hydraulic medium flow to the hydraulic medium ducts due to the action of the hydraulic medium supply pressure.

6. The camshaft adjuster as recited in claim 1 wherein the adjuster permits the hydraulic medium flow to the first and second hydraulic medium ducts due to the action of the hydraulic medium supply pressure.

7. The camshaft adjuster as recited in claim 1 wherein the adjuster is hydraulically locked in an intermediate position.

8. The camshaft adjuster as recited in claim 1 further comprising a third hydraulic medium duct positioning the adjuster in an intermediate position.

9. The camshaft adjuster as recited in claim 1 further comprising a spring positioning the adjuster in an intermediate position.

10. The camshaft adjuster as recited in claim 1 further comprising a seal sealing the first and second working chambers so that a level of the hydraulic medium is maintained in the first and second working chambers.

* * * * *